United States Patent [19]

Nakamura et al.

[11] Patent Number: 4,825,560

[45] Date of Patent: May 2, 1989

[54] ELECTRIC CLOTHES DRYER

[75] Inventors: Shin Nakamura, Hitachi; Shinichi Kaji, Katsuta, both of Japan

[73] Assignee: Hitachi, Ltd., Tokyo, Japan

[21] Appl. No.: 134,021

[22] Filed: Dec. 17, 1987

[30] Foreign Application Priority Data

Dec. 29, 1986 [JP] Japan ..... 61-199122[U]

[51] Int. Cl.[4] ..... F26B 11/04

[52] U.S. Cl. ..... 34/133; 34/139

[58] Field of Search ..... 34/75, 133, 77, 242, 34/139

[56] References Cited

U.S. PATENT DOCUMENTS 4,069,596 1/1978 Sisler ..... 34/133 X 4,112,590 9/1978 Muller ..... 34/133 X

FOREIGN PATENT DOCUMENTS 60-900 4/1985 Japan ..... 34/133

*Primary Examiner*—Henry A. Bennet

*Attorney, Agent, or Firm*—Antonelli, Terry & Wands

[57] ABSTRACT

The heat source apparatus is positioned at an outer peripheral portion of a rotative drum and an upper portion of an inhale port member of a drum supporting member for supporting the rotative drum. The heater of the heat source apparatus is positioned at an axial direction of a rotational axis of the rotative drum within a heater case. The heat source apparatus is installed at an upper corner portion of an outer frame with a heater case supporting member. The heat source apparatus and the inhale port of the drum supporting member are communicated with a C-shaped form duct. The apparatus offers the advantage that the back flow and the accumulation of the lint etc. generated from the clothes in the rotative drum to the heat source apparatus can be prevented.

6 Claims, 3 Drawing Sheets

ELECTRIC CLOTHES DRYER

BACKGROUND OF THE INVENTION

1. Field of the Invention

The present invention relates to an electric clothes dryer and more particularly to an electric clothes dryer suitable for back flow prevention and accumulation prevention of the lint etc., which is generated from the clothes in a rotative drum, into a heater of a heat source apparatus side.

2. Description of Prior Art

In the conventional electric clothes dryer, a heat source apparatus having a heater has been installed around a plurality of hot air inhale ports 5 of a rotative drum which receives the clothes therein. The heater is installed at a rear portion side of the rotative drum. The electric clothes dryer having the above stated heat source apparatus structure is disclosed in, for example, Japanese Patent Laid-Open No. 60900/85.

According to the stirring motion of the clothes in the rotative drum, the ventilating air resistance at an exhaust air side of the rotative drum may increase, for example, due to the condition of the blinding phenomenon of a lint filter apparatus caused by no cleaning of the lint filter apparatus. The ventilating air, which flows commonly from the heat source apparatus side to the interior portion of the rotative drum side, however, flows backward from the interior portion of the rotative drum to the heat source apparatus side according to circumstances.

Then the lint etc. generated from the clothes in the rotative drum gets into the heat source apparatus side. The lint etc. attach to a heater in the heat source apparatus and are burned thereon, as a result the dryer gives out a foul smell. In addition to this, after the lint etc. may be accumulated in the interior portion of the heat source apparatus, the lint etc. are burned by heat of the heater in the heat source apparatus. When things come to the worst, there is the extremely serious problem that the lint may burst into flames and the flames reach into the interior portion of the rotative drum and as a result the clothes in the rotative drum start to burn.

SUMMARY OF THE INVENTION

An object of the present invention is to provide an electric clothes dryer wherein an electric clothes dryer having high safety can be obtained.

Another object of the present invention is to provide an electric clothes dryer wherein an electric clothes dryer having high quality can be obtained.

A further object of the present invention is to provide an electric clothes dryer wherein the lint etc. are prevented from flowing backward to the heat source apparatus, as a result of wind pressure caused by stirring the clothes in the rotative drum.

A still further object of the present invention is to provide an electric clothes dryer wherein the lint etc. are prevented from getting into the heat source apparatus, as a result of wind pressure caused by stirring the clothes in the rotative drum.

In accordance with the present invention, an electric clothes dryer comprises a main casing, a rotative drum being housed in the main casing for receiving the clothes, a heat source apparatus having a heater means being installed within the main casing for generating hot air, a motor being installed within the main casing and for driving the rotative drum, a lint filter apparatus being installed with the rotative drum.

The heat source apparatus is positioned at an outer peripheral portion and an upper portion of the rotative drum. In particular, the heat source apparatus is positioned at an an upper portion of an inhale port member of a drum supporting member for supporting the rotative drum.

The heat source apparatus for supplying hot air is positioned at the outer peripheral portion and the upper portion of the rotative drum. At the worst, the ventilating air resistance increases at the exhaust air side and the lint etc. are prevented from flowing backward and getting into the heat source apparatus, due to arisen from wind pressure caused by stirring the clothes in the rotative drum.

According to the present invention, the prevention for the back flow and the accumulation of the lint etc. generated from the clothes in the rotative drum into the heat source apparatus can be realized, thereby the electric clothes dryer having high safety and high quality can be obtained.

DETAILED DESCRIPTION OF EMBODIMENT

Figure 1:
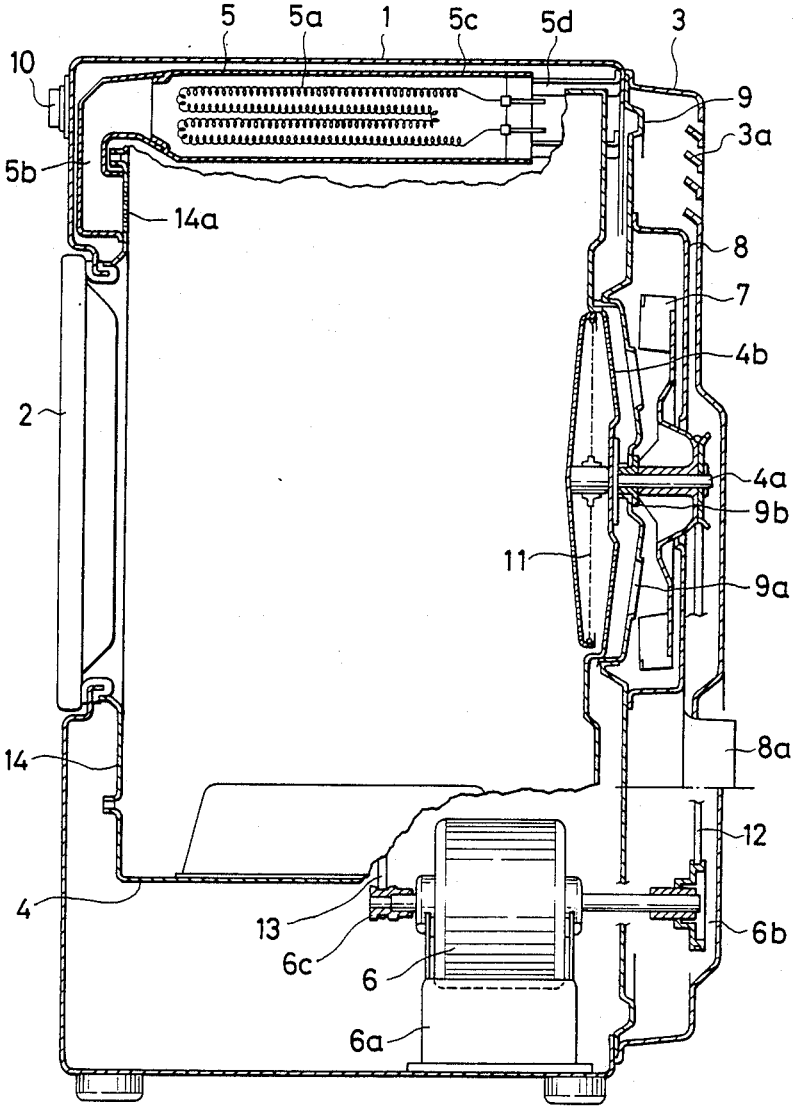
FIG. 1 is a longitudinal cross-sectional view of an electric clothes dryer according to one embodiment of the present invention.
Figure 2:
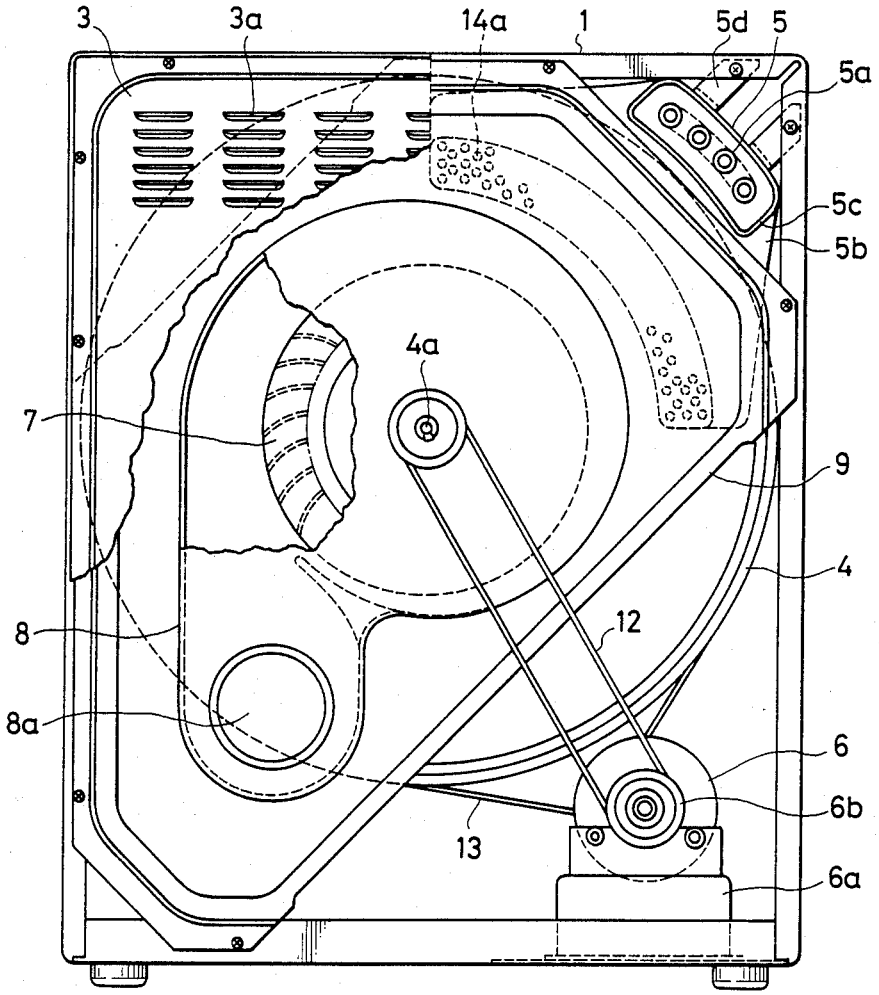
FIG. 2 is a back view of the electric clothes dryer in which a part of a rear cover is deleted.
Figure 3:
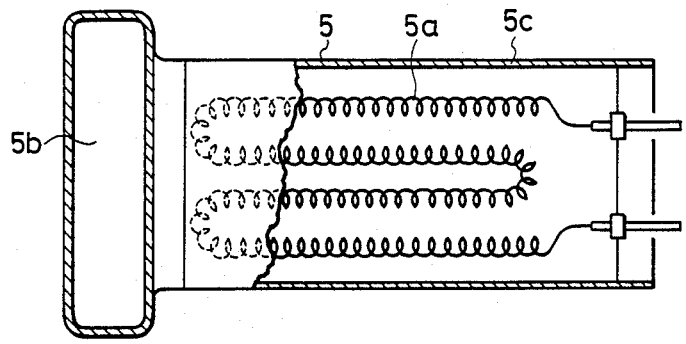
FIG. 3 is a partial cross-sectional view of a heat source apparatus shown in FIG. 1.
Figure 4:
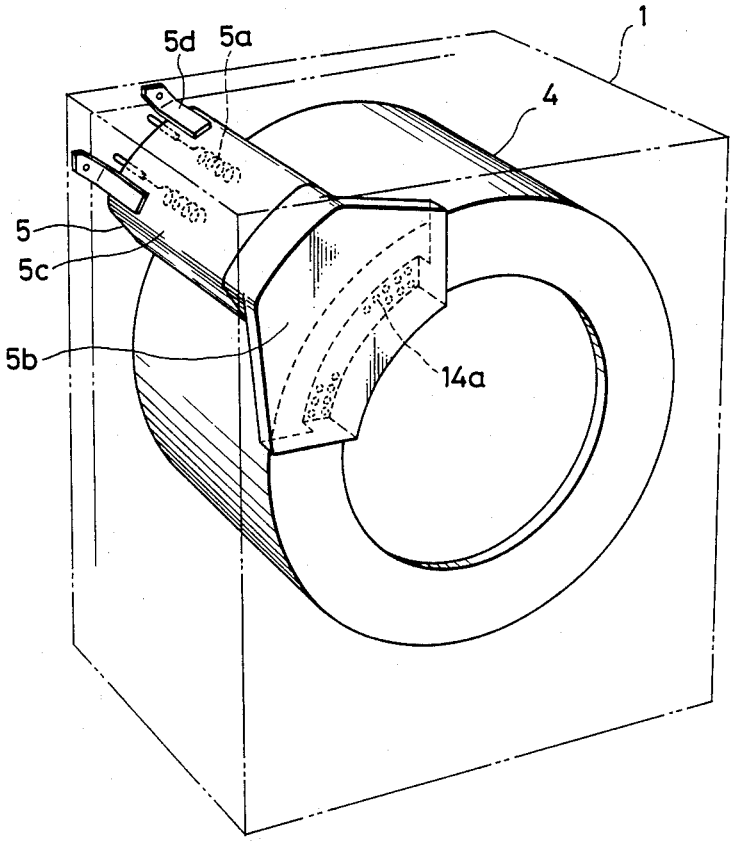
FIG. 4 is a schematic view of the electric clothes dryer having the heat source apparatus.

One embodiment of an electric clothes dryer of the present invention will be explained in accordance with drawings. The electric clothes dryer includes a main casing. The main casing is constituted by an outer frame 1 and a rear cover 3 having a plurality of air inlet holes 3*a* therein.

A rotative drum 4 is housed in this main casing and rotatively supported at a front portion by a ring shaped drum supporting member 14. The rotative drum 4 receives the clothes therein and is driven rotatively. The drum supporting member 14 is fixed on the outer frame 1 at a front side thereof and has a plurality of drum inhale ports 14a at an upper portion of the front side thereon. The drum inhale ports 14*a* of the drum supporting member 14 are each constituted generally as a punched opening in the metal member 14.

A drum bearing member 9*b* is mounted on a drum supporting plate 9. The drum supporting plate 9 is fixed on the outer frame 1 and has blower inlet holes 9*a* thereon. The rotative drum 4 is rotatively supported by the drum supporting member 14 at the front side thereof and by a drum shaft 4*a* at the rear side thereof and further through the drum bearing a member 9*b*.

The clothes are housed in the interior portion of the rotative drum 4 and the drying operation is carried out by the supply of hot air from a heat source apparatus 5. The heat source apparatus 5 is installed at one of the upper corner portions of the outer frame 1. The drum supporting member 14 covers the front side of the rotative drum 4 and constitutes a part of a wall portion of a clothes receiving chamber.

The rotative drum 4 has drum exhaust air holes 4*b* at a rear portion thereof. A lint filter apparatus 11 is installed at the front side of the drum exhaust air holes 4b of the rotative drum 4 so as to collect the lint etc. generated from the clothes in the rotative drum 4.

A blower fan 7 is provided at the rear side of the drum exhaust air hole 4b so as to suck air from the interior portion of the rotative drum 4. The blower fan 7 is installed in a fan casing and supported by the drum shaft 4a. The fan casing of the blower fan 7 is constituted by the drum supporting plate 9 and a casing 8. At the front side of the rotative drum 4, a closing door 2 is mounted on the outer frame 1 of the main casing so as to cover the entrance for the clothes in the rotative drum 4.

The heat source apparatus 5 has a coil shaped form heater 5a inside thereof and the heater 5a is provided within a cylindrical heater case 5c for receiving the heater 5a. The heat source apparatus 5 is mounted at an upper portion and an outer peripheral portion of the rotative drum 4 and is installed to the outer frame 1 of the main casing through two plate shaped form heater case supporting frames 5d.

The heat source apparatus 5 and the drum inhale port 14a of the drum supporting member 14 are communicated by a C-shaped form duct 5b. The duct 5b is fixed around the drum inhale port 14a of the drum supporting member 14. One cylindrical end portion of the heater case 5c is inserted in one cylindrical end portion of the duct 5b with faucet joint condition.

The heater 5a of the heat source apparatus 5 is positioned so as to extend in an axial direction of that is, parallel to a rotational axis of the rotative drum 4. Namely, the heater 5a of the heat source apparatus 5 is arranged above and at an outer cylindrical portion or a frame peripheral portion of the rotative drum 4 along substantially the longitudinal direction thereof.

The passage for air circulation is formed in turn between the air inlet holes 3a of the rear cover 3, the heater 5a of the heat source apparatus 5, the duct 5b, the drum inhale ports 14a of the drum supporting member 14, the interior portion of the rotative drum 4, the lint filter apparatus 11, the drum exhaust air hole 4b of the rotative drum 4, the blower inlet hole 9a of the drum supporting plate 9, the blower fan 7 and the exhaust air port 8a of the casing 8.

A motor 6 is installed at a bottom portion of the outer frame 1 of the main casing via a motor base 6a. A fan pulley 6a is mounted on one end of a shaft of the motor 6. The fan pulley 6b drives the blower fan 7 via a fan belt 12. A drum pulley 6c is mounted on at another end portion of the shaft of the motor 6. The drum pulley 6c drives the rotative drum 4 via a drum belt 13. A controlling apparatus 10 controls the operation of the motor 6 and the heater 5a of the heat source apparatus 5 and determines the operating program of the electric clothes dryer.

The operation and effects of the electric clothes dryer having the heat source apparatus of the above embodiment of the present invention, are explained below.

When the cleaning of the lint filter apparatus 11 of the electric clothes dryer is not performed or forgotten, the blinding condition occurs at the lint filter apparatus 11. Then air flow by the blower fan 7 is restrained by the blinding condition of the lint filter apparatus 11, however, the rotative drum 4 continues to rotate.

At that occasion, by the blast of the stirred clothes in the rotative drum 4, the dust such as lint etc. generated from the clothes in the rotative drum 4 begins to flow backward to the drum inhale port 14a side of the drum supporting member 14 from the interior portion of the rotative drum 4. The drum inhale port 14a of the drum supporting member 14 constitutes an opening portion for communicating the electric clothes dryer main body and the air outside.

However, the wind pressure caused by the blast of the stirred clothes in the rotative drum 4 of the electric clothes dryer does not apply force against the dust so as to reach the drum inhale ports 14a of the drum supporting member 14, because of the pressure loss caused in the duct 5b at elbow portions thereof and because the drum inhale port 14a of the drum supporting member 14 is positioned at the upper portion thereof. Thereby dust back flow to the heat source apparatus 5 can be prevented.

At the worst, even if the wind pressure caused by the blast of the stirred clothes is more than above stated generated value, the dust back flow into the heater 5a of the heat source apparatus 5 can be prevented, because the heat source apparatus 5 is positioned at a higher upper portion position than the installing position of the drum inlet ports 14a of the drum supporting member 14 and further because of the special structure of the drum inhale ports 14a of the drum supporting member 14.

As the drum inhale port 14a of the drum supporting member 14 is constituted generally as punched opening in a metal form and such an opening structure has a large resistance to air, the dust circulation to the heat source apparatus 5 side can be prevented against the wind pressure which is in relation to the degree of the blast for the clothes.

By the installing position of the heater 5a and the heater case 5c of the heat source apparatus 5 with the heater case supporting frame 5d at the outer peripheral portion and the upper portion to the rotative drum 4, the installing position of the heat source apparatus 5 with the drum inhale port 14a of the drum supporting member 14 is placed at the 180° reversed position with the C-shaped duct 5b having two elbow portions. Thereby the dust such as lint etc. back flow to the heat source apparatus 5 from the interior portion of the rotative drum 4 can be prevented effectively.

When the heater 5a and the heater case 5c of the heat source apparatus 5 is positioned at the outer peripheral portion of the rotative drum 4, the heat source apparatus 5 is positioned in general at an axial direction with the rotational axis of the rotative drum 4 as shown in the above embodiment of the present invention.

Then the outer cylindrical portion or the frame portion of the rotative drum 4 is warmed up by radiant heat generated by the heat source apparatus 5. Further the incidental effect can be obtained, that is, the amount of radiant heat portion by the heat source apparatus 5, which was considered as useless one before, can be utilized effectively so as to dry the clothes in the rotative drum 4 of the electric clothes dryer.

Besides, from the standpoint of the effective use of the radiant heat generated from the heat source apparatus 5, the heat source apparatus 5 may be positioned at the outer peripheral portion and moreover at the lower portion of the rotative drum 4 with the drum inhale port 14a, which is positioned at the lower portion of the drum supporting member 14, for the purpose of applying convection heat.

However, the above stated installing position of the heat source apparatus 5 at the lower portion in the rotative drum 4 runs counter to the settlement of the problems considering the back flow prevention and the accumulation prevention of the lint etc. with the heat source apparatus 5 because the lint etc. accumulate easily at the lower portion of the rotative drum 4 of the electric clothes dryer.

We claim:

1. An electric clothes dryer comprising a main casing, a rotative drum housed in said main casing for receiving the clothes, a heat source apparatus having a heater means installed within said main casing for generating hot air, a motor installed within said main casing for driving said rotative drum, a lint filter apparatus installed with said rotative drum, said main casing having a rectangular parallelepiped form and comprising an outer frame and a rear cover, and said heat source apparatus being positioned at an outer peripheral portion and an upper portion of said rotative drum, and wherein said heat source apparatus is installed at an upper corner portion of said outer frame of said main casing.

2. An electric clothes dryer according to claim 1, wherein said heat source apparatus is positioned at an outer peripheral portion of said rotative drum and an upper portion of an inhale port member of a drum supporting member for supporting said rotative drum.

3. An electric clothes dryer according to claim 1, wherein said heat source apparatus is positioned at an outer peripheral portion of said rotative drum and an upper portion of an inhale port member of a drum supporting member for supporting said rotative drum and further said heater means of said heat source apparatus is provided within a heater case and is positioned at an axial direction of a rotational axis of said rotative drum.

4. An electric clothes dryer according to claim 2, wherein said heat source apparatus and said inhale port of said drum supporting member are communicated with a duct means which is in a C-shape form and which has two elbow portions, and wherein a heater case for receiving said heater means of said heat source apparatus is inserted in said duct means at faucet joint condition.

5. An electric clothes dryer according to claim 1, wherein a heater case for receiving said heater means of said heat source apparatus is installed to said upper corner portion of said outer frame of said main casing with a heater case supporting member.

6. An electric clothes dryer comprising a main casing having a rectangular parallelepiped form and including an outer frame and a rear cover, a rotative drum being housed in said main casing for receiving the clothes, an inhale port member of a drum supporting member supporting said rotative drum, a heat source apparatus having a heater means being installed within said main casing for generating hot air, a motor being installed within said main casing for driving said rotative drum, and a lint filter apparatus being installed with said rotative drum, and wherein said heat source apparatus is positioned at an outer peripheral portion and an upper portion of said rotative drum and further is installed at an upper corner portion of said outer frame of said main casing, said heat source apparatus and said inhale port of said drum supporting member for supporting said rotative drum are communicated with a duct means, said heater means of said heat source apparatus is provided within a heater case for receiving said heater means and is positioned at an axial direction of a rotational axis of said rotative drum, and said heater case of said heat source apparatus is installed at an upper corner portion of said outer frame of said main casing with a heater case supporting member.

* * * * *